US006745599B2

(12) United States Patent
Bailey

(10) Patent No.: US 6,745,599 B2
(45) Date of Patent: Jun. 8, 2004

(54) KNITTED FABRIC

(75) Inventor: Shamiel Bailey, Cape Town (ZA)

(73) Assignee: Alnet (Proprietary) Limited (ZA)

( * ) Notice: Subject to any disclaimer, the term of this patent is extended or adjusted under 35 U.S.C. 154(b) by 0 days.

(21) Appl. No.: 10/433,215

(22) PCT Filed: Nov. 30, 2001

(86) PCT No.: PCT/IB01/02271

§ 371 (c)(1),
(2), (4) Date: Jul. 31, 2003

(87) PCT Pub. No.: WO02/44452

PCT Pub. Date: Jun. 6, 2002

(65) Prior Publication Data

US 2004/0035154 A1 Feb. 26, 2004

(30) Foreign Application Priority Data

Nov. 30, 2000 (ZA) ..... 00/7092

(51) Int. Cl.[7] ..... D04B 21/14
(52) U.S. Cl. ..... 66/192; 442/305
(58) Field of Search ..... 66/190, 191, 193, 66/169 R, 170, 195, 202; 442/305, 313, 314

(56) References Cited

U.S. PATENT DOCUMENTS 3,474,644 A 10/1969 Frank
4,067,210 A * 1/1978 Arons et al. ..... 66/202
4,183,993 A * 1/1980 Benstead et al. ..... 66/190
4,626,465 A 12/1986 Henningsson
4,632,863 A * 12/1986 Henningsson ..... 66/192
5,164,250 A * 11/1992 Paz Rodriguez ..... 442/186
5,288,545 A * 2/1994 De Decker ..... 139/29
5,542,269 A * 8/1996 Richards ..... 66/195
6,615,618 B2 * 9/2003 Kost ..... 66/193

FOREIGN PATENT DOCUMENTS

DE 3025 781 A1 2/1982
DE 237 334 A1 7/1986
EP 0 791 306 A1 8/1997

* cited by examiner

*Primary Examiner*—Danny Worrell
(74) *Attorney, Agent, or Firm*—James Ray & Associates

(57) ABSTRACT

A knitted fabric for use as a shade net, comprises a single series of 400 Denier monofilament threads M of high density polyethylene (HDPE) which are formed into pillar stitches, a second series of HDPE 350 Denier monotapes which are knitted in a zig-zag fashion to form a Sammt stitch, and a third series of HDPE 350 Denier monotapes which are added as a filler. The fabric is knitted on a warp knitting machine wherein the gaps between the latch needles are ⅛ of an inch. The monofilament threads extend in a warp direction and the second series of monotapes extend in a weft direction. The monotapes of the second series traverse four needle gaps, whereas the monotapes of the third series traverse two adjacent needles in a weft direction.

10 Claims, 3 Drawing Sheets

KNITTED FABRIC

This application is a 371 of PCT/1B01/02271 Nov. 30, 2001.

FIELD OF INVENTION

THIS INVENTION relates to a knitted fabric, and more particularly to a knitted fabric which is suitable for use as shade net.

SUMMARY OF INVENTION

According to a first aspect of the invention there is provided a knitted fabric which is produced on a warp knitting machine employing three guide bars, the fabric comprising

- a first series of monofilament threads wherein each monofilament thread is formed into pillar stitches extending in a warp direction, by a first of the guide bars;
- a second series of monotapes which are knitted in a zig-zag fashion to form a Sammt stitch extending in a weft direction relative to the monofilament threads; and
- a third series of monotapes which are added to the monofilament threads and the monotapes as a filler.

The monofilament threads may have 11½ pillar stitches per inch of fabric.

The needle gaps of the warp knitting machine may be ⅛ of an inch. The monotapes of the second series may extend across the equivalent of four needle gaps in a weft direction.

The monofilament threads may be of high density polyethylene of approximately 400 Denier.

The monotapes of the second series may be of high density polyethylene of approximately 350 Denier.

The monotapes of the second series may have a width of approximately 1.8 mm and a thickness of approximately 0,035 mm.

The monotapes of the third series may be added to the monofilament threads and the monotapes of the second series to traverse the equivalent of one needle gap in a weft direction to provide a filler.

The monotapes of the third series may be of high density polyethylene of approximately 350 Denier.

The monotapes of the third series may have width of approximately 1.8 mm and a thickness of approximately 0.035 mm.

BRIEF DESCRIPTION OF THE DRAWINGS

Further features of the invention are described hereinafter by way of a non-limiting example of the invention, with reference to the accompanying drawings.

In the drawings.

DESCRIPTION OF THE PREFERRED EMBODIMENTS

Figure 1:
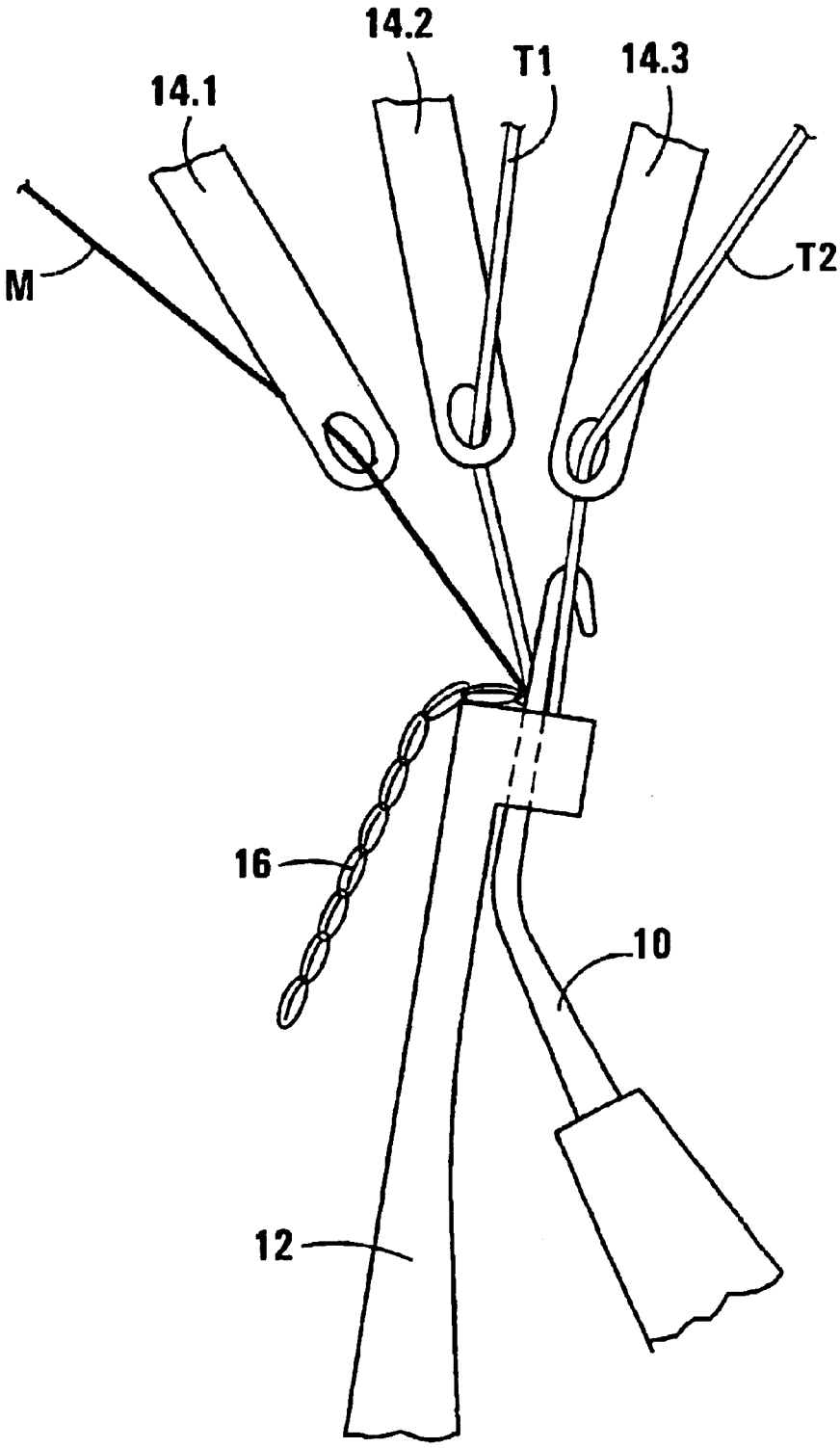
FIG. 1 is a vertical section of a warp knitting machine of the type used to make a fabric in accordance with the invention.

Referring first to FIG. 1, a 16 gauge Raschel-type warp knitting machine comprises a series of latch needles 10, a trick plate 12, and three guide bars, the first guide bar carrying a series of guide needles 14.1, the second guide bar carrying a series of guide needles 14.2, and the third guide bar carrying a series of guide needles 14.3. The latch needles of the knitting machine are spaced ⅛ of an inch apart. Hence, the needle gaps are ⅛ of an inch. A knitted fabric 16 made on the knitting machine comprises a single series of monofilament threads M each of which passes through the eye of a corresponding one of the guide needles 14.1, a second series of threads in the form of monotapes T1 each of which passes through the eye of a corresponding one of the guide needles 14.2, and a third series of threads in the form of monotapes T2 each of which passes through the eye of a corresponding one of the guide needles 14.3.

The threads M are 400 Denier monofilament threads of high density polyethylene. The tapes T1 and T2 are each in the form of a 350 Denier high density polyethylene tape, having a width of 1.8 mm and a thickness of 0.035 mm.

Figure 2:
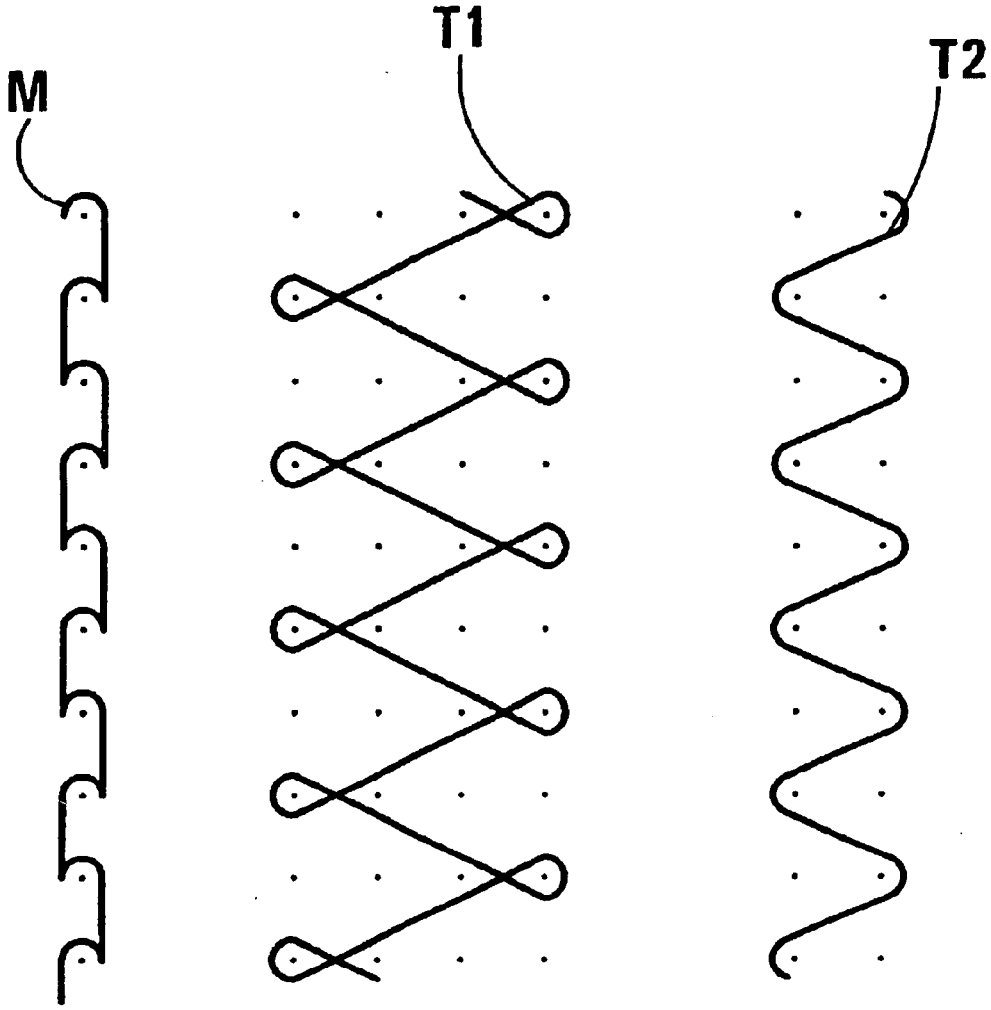
FIG. 2 is a pattern diagram illustrating the configuration of the different stitches of the threads forming the knitted fabric.
Figure 3:
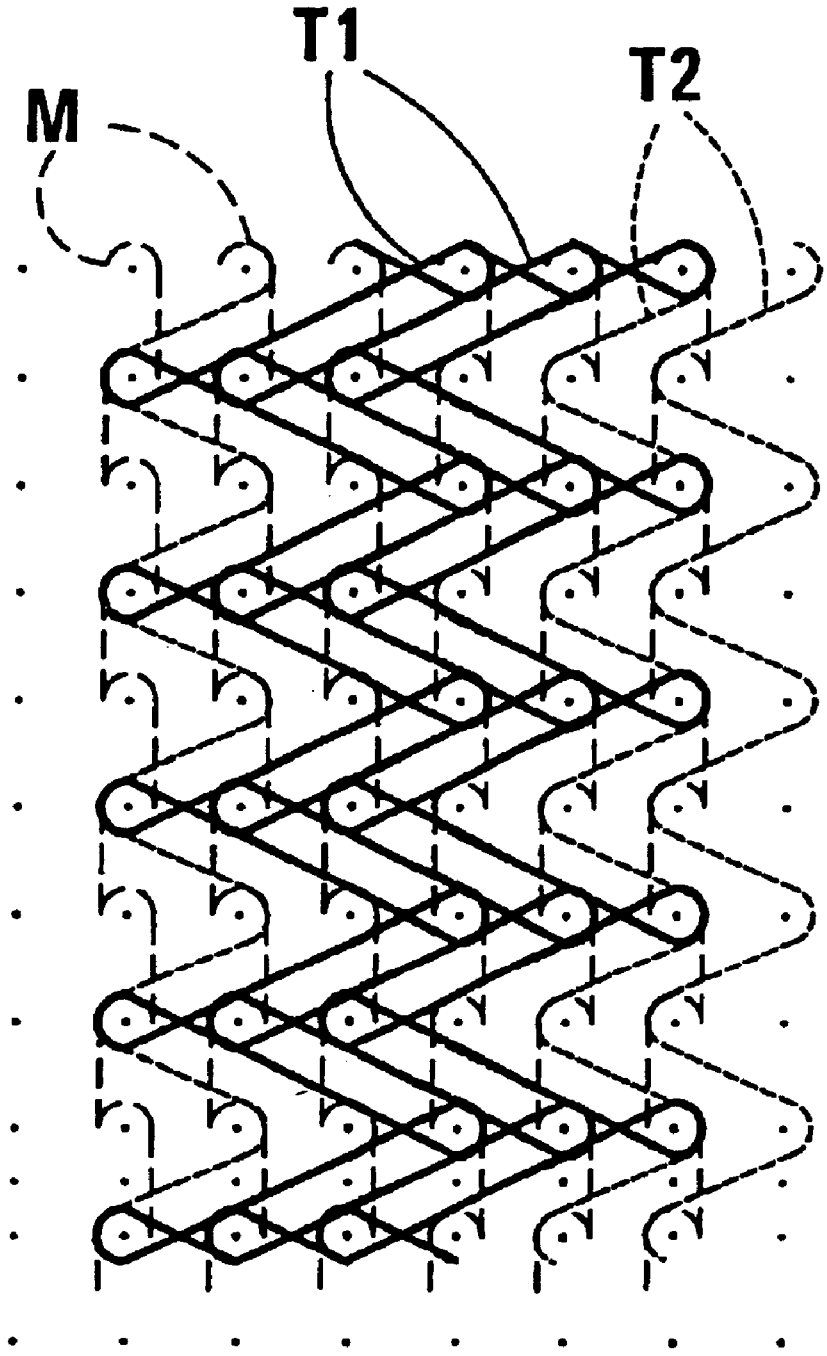
FIG. 3 is a pattern diagram which illustrates the knit configuration of the fabric.

As can be seen in FIG. 2, each of the monofilament threads M are knitted to form a pillar stitch which gives the fabric strength in the longitudinal or warp direction. The monofilament threads are knitted with 11½ pillar stitches per inch of fabric. The tapes T1 are knitted in a zig-zag fashion to form a binding between adjacent pillar stitches and to provide the fabric with the required shade-giving and ultra-violet (UV) light protection properties. The tapes T1 are knitted in a closed "Sammt" stitch and traverse the equivalent of four needle gaps in a weft direction per machine cycle. The monotapes T2 is added to the monofilament threads M and the monotapes T1 and traverse two adjacent needles in a weft direction. The monotapes T2 fulfill a filling purpose and provide the fabric with shade protection and UV light protection properties. As such, the configuration of the monotapes T1 and T2, in particular, provide the knitted fabric with its "coverage" properties for shade protection and U-V light protection. As there are two guide bars knitting during the production phase, this will prevent any form of unravelling of the knitted end product.

Due to the knit configuration of the knitted fabric, the fabric exhibits equal elongation and tensile strength properties in both warp and weft directions. The knit configuration thus provides a knitted fabric having uniform properties in both warp and weft directions.

Due to the material properties and stitches used for the monotapes of the second and third series, the monotapes exhibit sufficient tensile strength in the weft direction, thereby obviating the need for monofilament threads in the weft direction.

The configuration of the monotapes T1 and T2, in particular, provide the knitted fabric with excellent coverage thus enhancing the U-V light protection and shade covering properties of the fabric.

The "throws" of the monotapes T1 in the knitted fabric are relatively long thereby providing a more stable knit fabric. The monofilament threads and the monotapes do not slide over one another. By utilising the Sammt construction to anchor the weft monotapes T1 with the pillar stitches of the monofilament threads, the fabric is provided with stability in both weft and warp directions.

The relatively tight knit configuration of the fabric provides the fabric with a smoother surface texture which allows for coating of the fabric with more precision thereby providing the fabric with enhanced aesthetic appeal.

The following pattern chain is used to set up the knitting machine and defines the knit configuration:

| Bar 1 | Bar 2 | Bar 3 |
|---|---|---|
| 2 | 6 | 0 |
| 0 | 8 | 0 |
| — | — | — |
| 0 | 2 | 4 |
| 2 | 0 | 4 |
| = | = | = |

What is claimed is:

1. A knitted fabric which is produced on a warp knitting machine employing three guide bars, the fabric comprising:

a first series of monofilament threads wherein each monofilament thread is formed into pillar stitches extending in a warp direction, by a first of the guide bars;

a second series of monotapes which are knitted in a zig-zag fashion to form a Sammt stitch extending in a weft direction relative to the monofilament threads; and a third series of monotapes which are added to the monofilament threads and the monotapes as a filler.

2. A knitted fabric as claimed in claim 1, wherein the monofilament threads are of high density polyethylene of approximately 400 Denier.

3. A knitted fabric as claimed in claim 2, wherein the needle gaps of the warp knitting machine are ⅛ of an inch.

4. A knitted fabric as claimed in claim 1, wherein the monotapes of the second series extend across the equivalent of four needle gaps in a weft direction.

5. A knitted fabric as claimed in claim 4, wherein the monotapes of the second series are of high density polyethylene of 350 Denier.

6. A knitted fabric as claimed in claim 4, wherein the monotapes of the second series have a width of approximately 1.8 mm and a thickness of approximately 0.035 mm.

7. A knitted fabric as claimed in claim 1, wherein the monotapes of the third series are added to the monofilament threads and the monotapes of the second series to traverse the equivalent of one needle gap in a weft direction, to form a filler.

8. A knitted fabric as claimed in claim 7, wherein the monotapes of the third series are of high density polyethylene of approximately 350 Denier.

9. A knitted fabric as claimed in claim 7, wherein the monotapes of the third series have a width of approximately 1.8 mm and a thickness of approximately 0.035 mm.

10. A knitted fabric as claimed in claim 1, wherein the monofilament threads have 11½ pillar stitches per inch of fabric.

* * * * *